US005303852A

United States Patent [19]

Yamawaki et al.

[11] Patent Number: 5,303,852

[45] Date of Patent: Apr. 19, 1994

[54] VISCOUS LIQUID-DISPENSING CONTAINER HAVING A RESILIENT FOLLOWER

[75] Inventors: Akitoshi Yamawaki, Ikeda; Kanetsugu Yoshiki, Takatsuki, both of Japan

[73] Assignee: Sunstar Kabushiki Kaisha, Osaka, Japan

[21] Appl. No.: 993,076

[22] Filed: Dec. 18, 1992

[30] Foreign Application Priority Data

Dec. 20, 1991 [JP] Japan ..... 3-111737[U]

[51] Int. Cl.[5] ..... B65D 37/00; B65D 5/42

[52] U.S. Cl. ..... 222/209; 222/386.5

[58] Field of Search ..... 222/94, 95, 105, 386.5, 222/206-213

[56] References Cited

U.S. PATENT DOCUMENTS

| | | | |
|---|---|---|---|
| 2,557,120 | 6/1951 | Knoblock . | |
| 2,608,320 | 8/1952 | Harrison | 222/105 |
| 2,777,612 | 1/1957 | Bensen . | |
| 3,241,722 | 3/1966 | Nissen | 222/386.5 |
| 3,580,429 | 5/1971 | Trindle | 222/105 X |
| 3,620,420 | 11/1971 | Normos | 222/386.5 |
| 3,656,660 | 4/1972 | Mueller | 222/94 |
| 4,089,443 | 5/1978 | Zrinyi | 222/386.5 |
| 4,469,250 | 9/1984 | Evezich . | |
| 4,562,942 | 1/1986 | Diamond | 222/386.5 |
| 4,842,165 | 6/1989 | Van Coney | 222/95 |
| 5,012,956 | 5/1991 | Stoody | 222/94 |
| 5,033,647 | 7/1991 | Smith et al. | 222/94 |

FOREIGN PATENT DOCUMENTS

| | | |
|---|---|---|
| 2081244 | 12/1971 | France . |
| 1139375 | 5/1989 | Japan . |
| 2184491 | 6/1987 | United Kingdom . |

*Primary Examiner*—Andres Kashnikow
*Assistant Examiner*—Kenneth DeRosa
*Attorney, Agent, or Firm*—Wegner, Cantor, Mueller & Player

[57] ABSTRACT

A viscous liquid-dispensing container which allows almost all amount of the content thereof to be easily extracted. The container includes a liquid-dispensing section having a head and a shoulder, and inner and outer containers respectively connected with the shoulder. The liquid-dispensing section includes a first check valve for allowing only extraction of the liquid. The outer container includes a second check valve for allowing only introduction of the exterior air. The inner container for accommodating the viscous liquid has a upper sleeve and lower bag connected to the upper sleeve. The upper sleeve is relatively hard, while the lower bag is made of a flexible thin film. After a predetermined amount of liquid is extracted, the lower bag is inverted and invades into the upper sleeve depending on the reduction of the liquid in the inner container.

3 Claims, 8 Drawing Sheets

VISCOUS LIQUID-DISPENSING CONTAINER HAVING A RESILIENT FOLLOWER

BACKGROUND OF THE INVENTION

1. Field of the Invention

The present invention generally relates to a viscous liquid-dispensing container, and particularly relates to the above type container which prevents viscous liquid from being influenced by air, can be easily manufactured, and allows the viscous liquid to be easily charged thereinto.

2. Description of the Prior Art

As a typical example of a viscous liquid-dispensing container containing viscous liquid such as cosmetics, food or the like, a dispensing package consisting of an elastic squeezing tube is disclosed in U.S. Pat. No. 4,842,165 and corresponding Japanese Patent Laid-Open Publication No. 1-139375. The dispensing package accommodates viscous liquid. When a certain amount of the viscous liquid is dispensed, external air flows into the dispensing package. At this time, the contact between the air and the viscous liquid is interrupted and the external air can be easily introduced into the dispensing package during the extraction of the viscous liquid. The dispensing package comprises a tube-shaped inner container or a flexible squeezing tube, and an elastic outer container. An intermediate portion of a flexible squeezing tube is thermally welded to the inner surface of the elastic outer container, and the lower half of the tube can be inverted in the upper half thereof. As a result, the viscous liquid accommodated in the inner container can be extracted. An air escape-limiting means, namely, an air-introducing portion provided with a check valve is formed on the bottom of the outer container so as to extract the viscous liquid accommodated in the inner container. A suckback valve is formed in the head of the dispensing package so that only the viscous liquid accommodated in the inner container is extracted to the outside, while the external air is prevented from flowing into the inner container when the outer container returns to the original configuration.

The dispensing package disclosed in the above U.S. and Japanese Publications comprises many parts and thus costs high and in addition, has some portions which are required to be assembled with difficulty. In particular, since the intermediate point of the tube consisting of laminated thin films is thermally welded to the inner surface of the outer container, a difficult operation is required to insert the inner container into the outer container and further, there is a possibility that the tube is damaged or broken in thermally welding the intermediate portion to the inner surface of the outer container, resulting in manufacture of defective dispensing packages. Further, since the inner container is made of the tube consisting of the laminated thin films, the inner container is frail and fitted into the outer container with difficulty and inefficiency, resulting in high cost manufacture of package.

SUMMARY OF THE INVENTION

The present invention has been made to solve the above-described problems and is intended to provide a viscous liquid-dispensing container which can be easily manufactured and allows viscous liquid to be easily charged into an inner container thereof.

The above-described object of the present invention can be achieved by a viscous liquid-dispensing container comprising a viscous liquid-dispensing section having a head and a shoulder means radially extending from a lower end of the head. The head includes an extracting path for the viscous liquid and a first check valve disposed at an appropriate position of the extracting path to allow extraction of the viscous liquid. The shoulder includes an outer mounting portion and an inner mounting portion.

The viscous liquid-dispensing container also includes a tube-shaped inner container and an elastic outer container. The tube-shaped inner container, for accommodating viscous liquid, includes a lower bag portion made of a flexible thin film and an upper sleeve portion harder than the lower bag portion and connected thereto. The upper end of the upper sleeve portion is connected with the inner mounting portion of the shoulder.

The elastic outer container surrounds the inner container. The upper end the outer container is connected with the outer mounting portion of the shoulder means. The outer container has a second check valve disposed at an appropriate place thereof and capable of introducing external air to the inside of the viscous liquid-dispensing container.

In the above-described viscous liquid-dispensing container, a space is formed between the inner and outer containers. Therefore, when the elastic outer container is compressed, the second check valve provided in the outer container does not allow air in the space between the inner and outer containers to flow to the outside, but the air is compressed so that the inner container is contracted by the pressure of the air, resulting in that the viscous liquid is extracted through the extracting path of the head to the outside.

Subsequently, a hand is released from the elastic outer container, the outer container will return to the original configuration. At this time, the first check valve provided in the head prevents the external air from flowing into the inner container. The viscous liquid remaining on the check valve in the extracting path is prevented from dripping out of an opening of the path because the path is shuttered by the check valve.

Air in the space between the inner and outer containers is decompressed depending on the amount of the viscous liquid extracted from the inner container. As a result, the second check valve provided in the outer container allows the external air to be introduced into the inner container. Consequently, the air pressure between the inner and outer containers becomes equal to the pressure of the external air. Therefore, the viscous liquid accommodated in the inner container can be extracted by a subsequent operation.

The upper sleeve portion of the inner container is relatively hard, while the lower bag portion is flexible. Therefore, after a predetermined amount of the viscous liquid has been extracted from the inner container, the lower flexible bag portion is inverted and invades into the upper sleeve portion. In this manner, the entire viscous liquid in the inner container can be easily extracted to the outside.

According to the viscous liquid-dispensing container of the present invention, it is not necessary to weld a part of a thin film of the inner container to the inner surface of the outer container in manufacturing the viscous liquid-dispensing container but the inner container is thermally welded to the inner mounting portion of the shoulder means. Therefore, the entire operation for assembling the viscous liquid-dispensing container is performed at a low cost, and the viscous liquid can be easily charged into the inner container with the lower end thereof open. In addition, the lower end of the inner container can be easily sealed.

BRIEF DESCRIPTION OF THE DRAWINGS

The present invention will be described below in detail with reference to the accompanied drawings, in which.

DETAILED DESCRIPTION OF THE INVENTION

Figure 1:
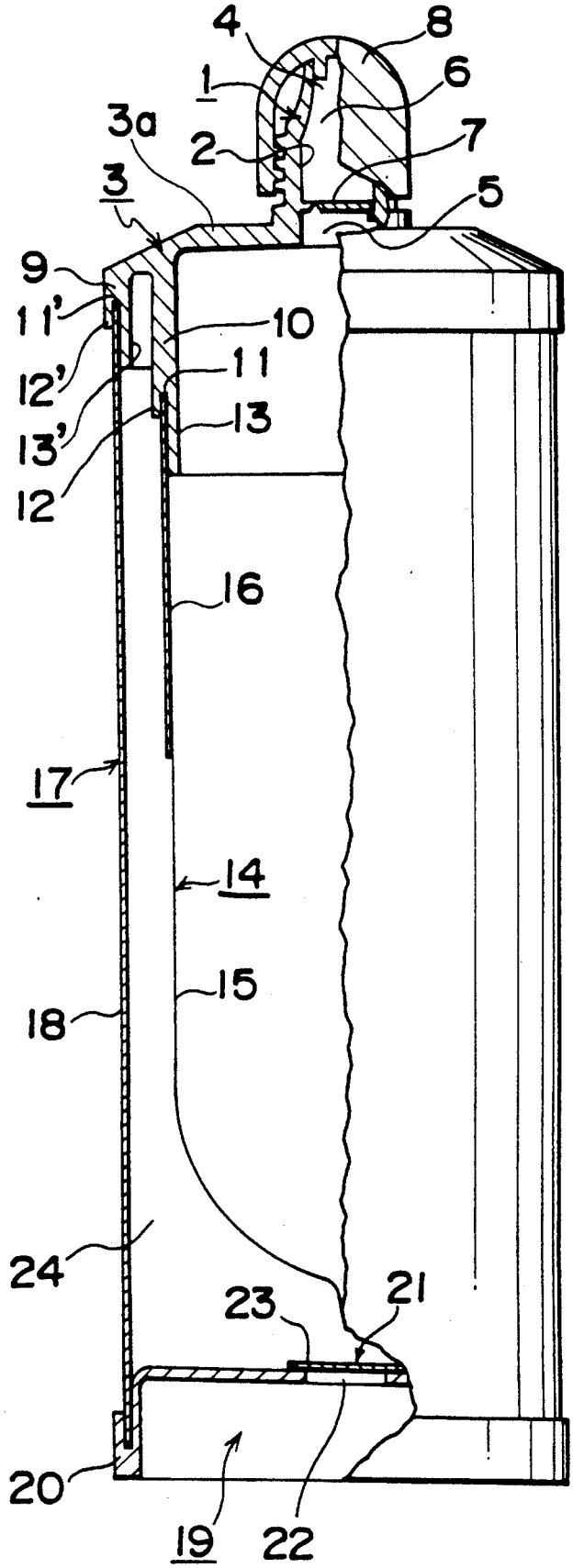
FIG. 1 is a partial sectional view showing a viscous liquid-dispensing container according to a first embodiment of the present invention.

Referring to FIG. 1, reference numeral 1 denotes a viscous liquid-dispensing section. The viscous liquid-dispensing section 1 comprises a head 2 and a shoulder 3 radially extending from a lower end of the head. The head 2 can be constructed in various configurations. In an embodiment shown in FIG. 1, an extracting opening 4 is formed on upper end of the head 2; an introducing opening 5 is formed at the lower end thereof; and an extracting path 6 connecting the extracting opening 4 and the introducing opening 5 with each other. A first check valve 7 for allowing the flow of viscous liquid toward the extracting opening 4 is formed in integration with the head 2 or by installing a separate valve member on an appropriate portion in the extracting path 6. Reference numeral 8 denotes a cap, formed outside the head 2, for covering the head 2 when the viscous liquid-dispensing container is not in use.

The shoulder 3 includes a top disc 3*a*, an outer mounting sleeve 9 and an inner mounting sleeve 10. Both mounting sleeves 9 and 10 are preferably integral with the top disc 3*a* in consideration of the manufacture thereof as shown in FIG. 1, but the outer mounting sleeve 9 and/or the inner mounting sleeve 10 may be shaped separately from the top disc 3*a* depending on a case and then connected with the top disc 3*a*. In the viscous liquid-dispensing container shown in FIG. 1, the inner mounting sleeve 10 extends downward from the periphery of the top disc 3*a* and a lower portion thereof is of double-wall construction to form an annular groove 11. That is, an outer mounting strip 12 and an inner mounting strip 13 are formed so as to define the groove 11 therebetween. The inner mounting strip 13 is longer than the outer mounting strip 12 so that the inner mounting strip 13 has a large thermal welding area in welding a tube-shaped inner container 14 to the inner mounting strip 13. The sectional configuration of the outer mounting sleeve 9 is similar to that of the inner mounting sleeve 10. That is, the outer mounting sleeve 9 extends downward from the top disc 3*a* and has a groove 11', the outer mounting strip 12', and the inner mounting strip 13'.

The tube-shaped inner container 14, shown in FIG. 1, for accommodating viscous liquid can be fixed to the inner mounting sleeve 10. Various kinds of synthetic resins may be used as the material of the tube-shaped inner container 14. In addition, the inner container 14 may be formed with a thin film made of synthetic resin, the outer surface, the inner surface or both surfaces of which may be aluminum-evaporated. In the embodiment shown in FIG. 1, the inner container 14 comprises a hard cylindrical upper sleeve 16 and a lower bag or lower tube 15 softer than the upper tube 16. The upper sleeve 16 is preferably made of a film of polyethylene or the like with thickness of 0.3–1.5 mm, while the lower tube 15 is preferably made of a film of polyethylene with thickness of 0.1–0.3 mm. The hard cylindrical tube 16 and the lower tube 15 may be integral with each other as one piece, but it is possible to adhere a thin film tube for the lower tube 15 to the upper sleeve 16 formed separately from the lower tube 15. In the embodiment shown in FIG. 1, the upper end of the lower tube 15 is adhered or thermally welded to the upper sleeve 16. The upper end of the upper sleeve 16 of the inner container 14 is thermally welded to the outer mounting strip 12 and/or the inner mounting strip 13, with the upper end of the sleeve 16 inserted into the mounting groove 11 of the inner mounting sleeve 10. In introducing the viscous liquid into the inner container 14, the viscous liquid is charged thereinto from the open lower end thereof and then the lower end thereof is thermally sealed before the assembly as shown in FIG. 1 is completed.

An elastic outer container 17 is disposed so as to surround the inner container 14. In the embodiment shown in FIG. 1, the elastic outer container 17 comprises an elastic sleeve 18 and a bottom lid member 19 disposed at the lower end thereof. The sleeve 18 consists of a thin sheet made of synthetic resin selected from many kinds of resins which ensures its elasticity. The upper end of the sleeve 18 can be heat-welded to the outer mounting strip 12' and/or the inner mounting strip 13' with the upper end thereof inserted into the groove 11 of the outer mounting sleeve 9. The bottom lid member 19 is thermally welded to the bottom of the sleeve 18 with the bottom of the cylindrical member 18 inserted into the engaging groove 20 formed in the periphery of the bottom lid member 19.

According to the present invention, a second check valve 21 capable of introducing air only from the outside of the viscous liquid-dispensing container to the inside thereof is formed on the lid member 19. Namely, the check valve 21 comprises a ventilation hole 22 formed in the lid member 19 and a disc-shaped valve member 23 which is installed on the inner side of the lid member 19 so as to cover the ventilation hole 22. The valve member 23 can elastically opens and closes the hole 22.

The method for manufacturing the viscous liquid-dispensing container shown in FIG. 1 will be described with reference to FIGS. 2 through 5.

Figure 3:
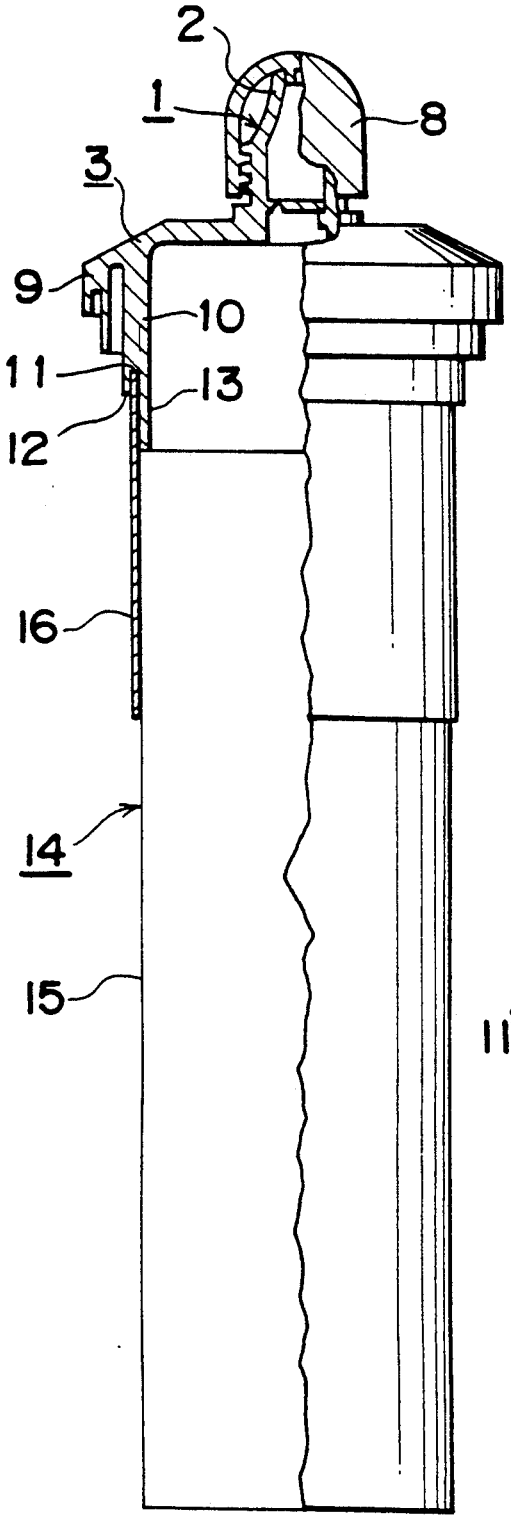
FIGS. 2 through 5 are explanatory views each showing a procedure in assembling the viscous liquid-dispensing container according to the first embodiment.
Figure 2:
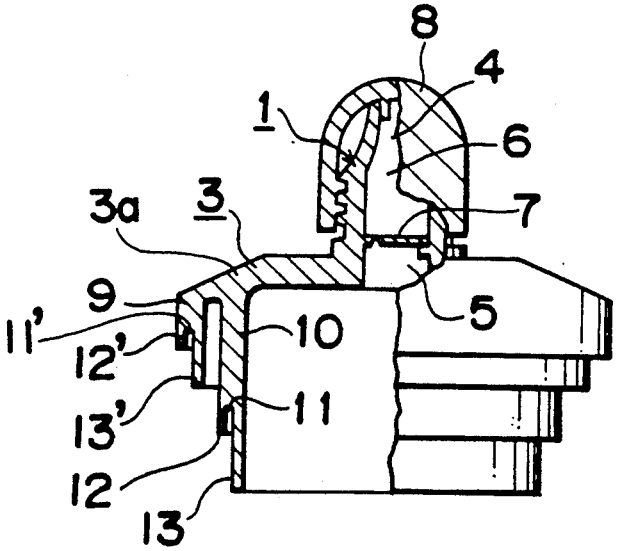
Figure 4:
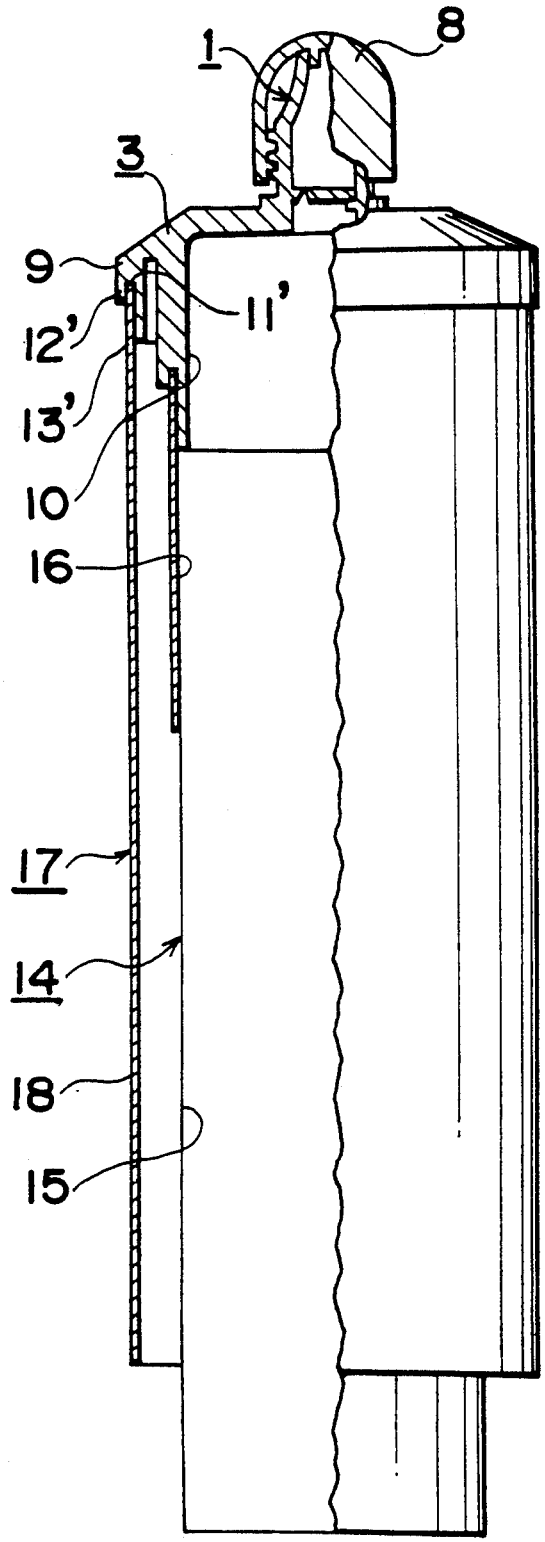
Figure 5:
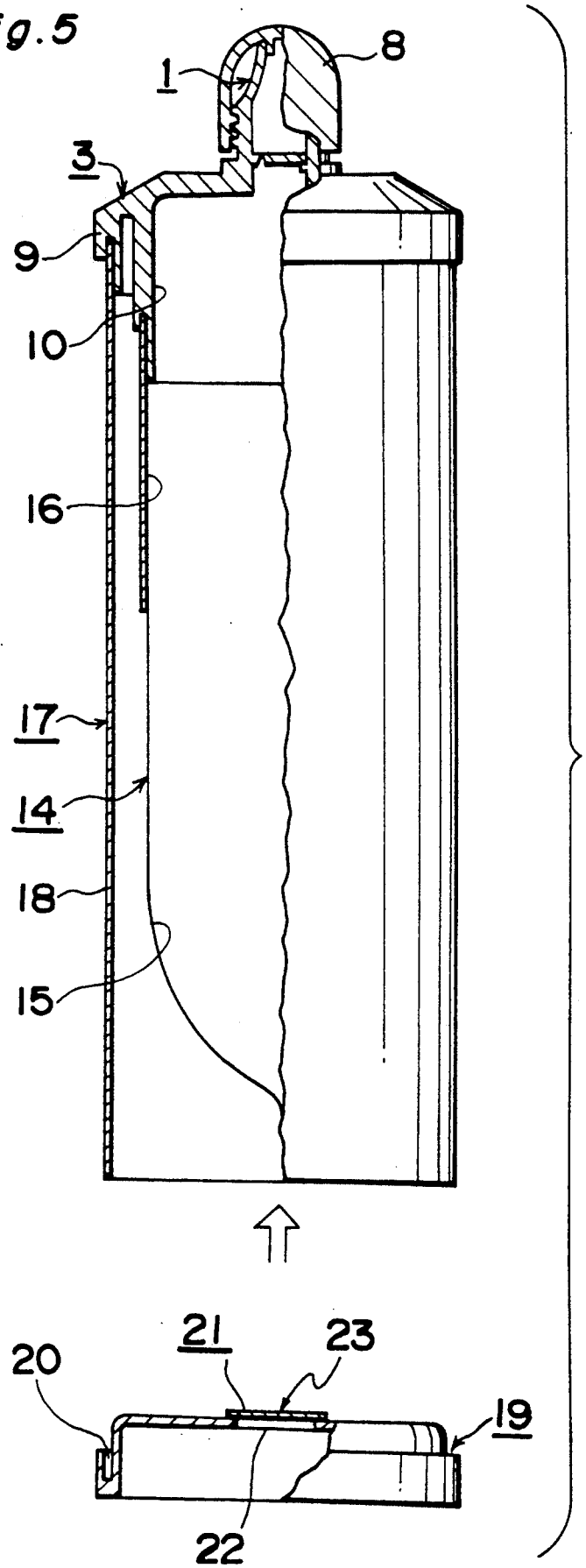

First, as shown in FIG. 2, solid synthetic resin is shaped into the viscous liquid-dispensing section 1. Then, as shown in FIG. 3, the inner container 14 is thermally welded to the inner mounting sleeve 10 of the viscous liquid-dispensing section 1 with the lower end of the inner container 14 open. Thereafter, as shown in FIG. 4, the outer sleeve 18 of the elastic outer container 17 is fitted over the inner container 14, the lower end of which is kept open, and the upper end of the sleeve 18 is thermally welded to the outer mounting sleeve 9 of the shoulder 3. Thereafter, the viscous liquid is charged from the open lower end of the inner container 14 to the inside thereof, and then, the lower end of the inner container 14 is closed as shown in FIG. 5. Finally, the bottom lid member 19 having the check valve 21 is thermally welded to the sleeve 18. In this manner, the viscous liquid-dispensing container can be entirely constructed.

Figure 6:
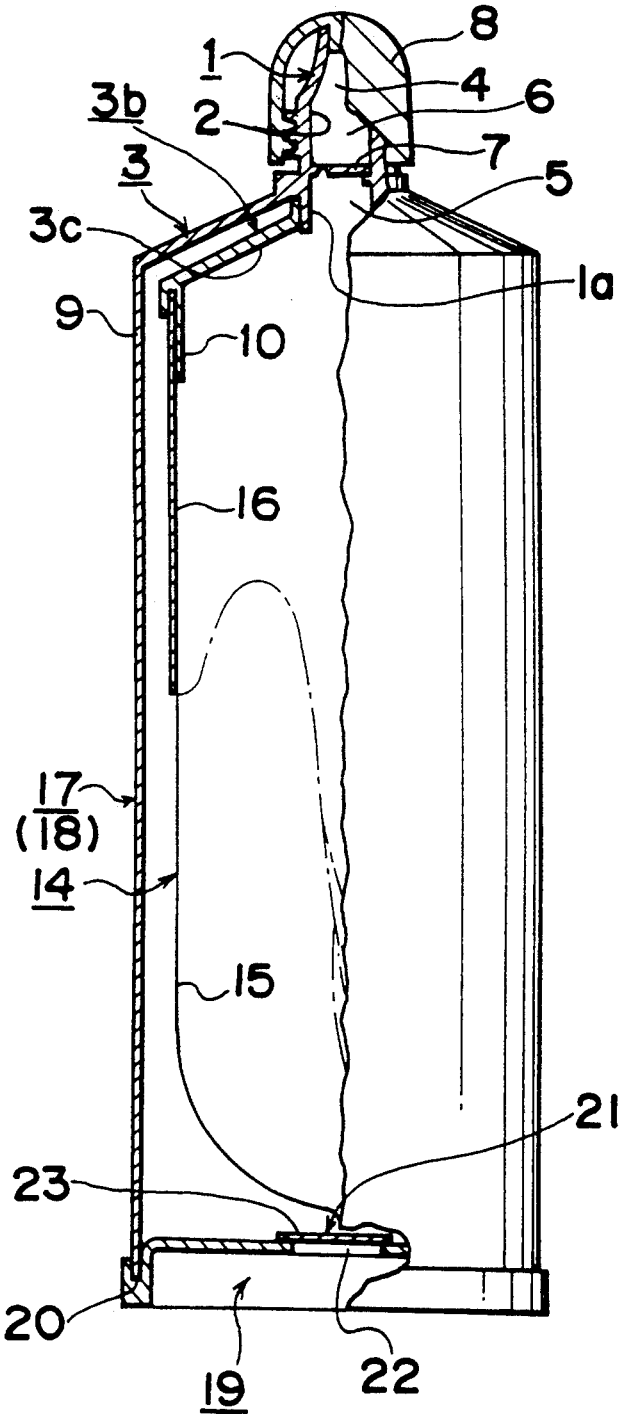
FIG. 6 is a partial sectional view showing a viscous liquid-dispensing container according to a second embodiment of the present invention.

FIG. 6 shows a viscous liquid-dispensing container according to another embodiment of the present invention. The liquid-dispensing section 1 and the outer sleeve 18 of the elastic outer container 17 are formed as one piece. Namely, the outer mounting sleeve 9 of the shoulder 3 constituting a part of the viscous liquid-dispensing section 1 and the outer sleeve 18 of the elastic outer container 17 are formed in integration with each other. However, the inner mounting sleeve 10 is separately formed from the liquid-dispensing section 1. Namely, a shoulder member **3*b* including a top disc 3*c* and the inner mounting sleeve 10 is heat-welded to the lower end 1*a* of the head 1 such that the path 6 communicates to the inside of the inner container. An end of the upper sleeve 16 of the inner container 14 connected with the lower tube 15 is thermally welded to the inner mounting sleeve 10**.

Figure 7:
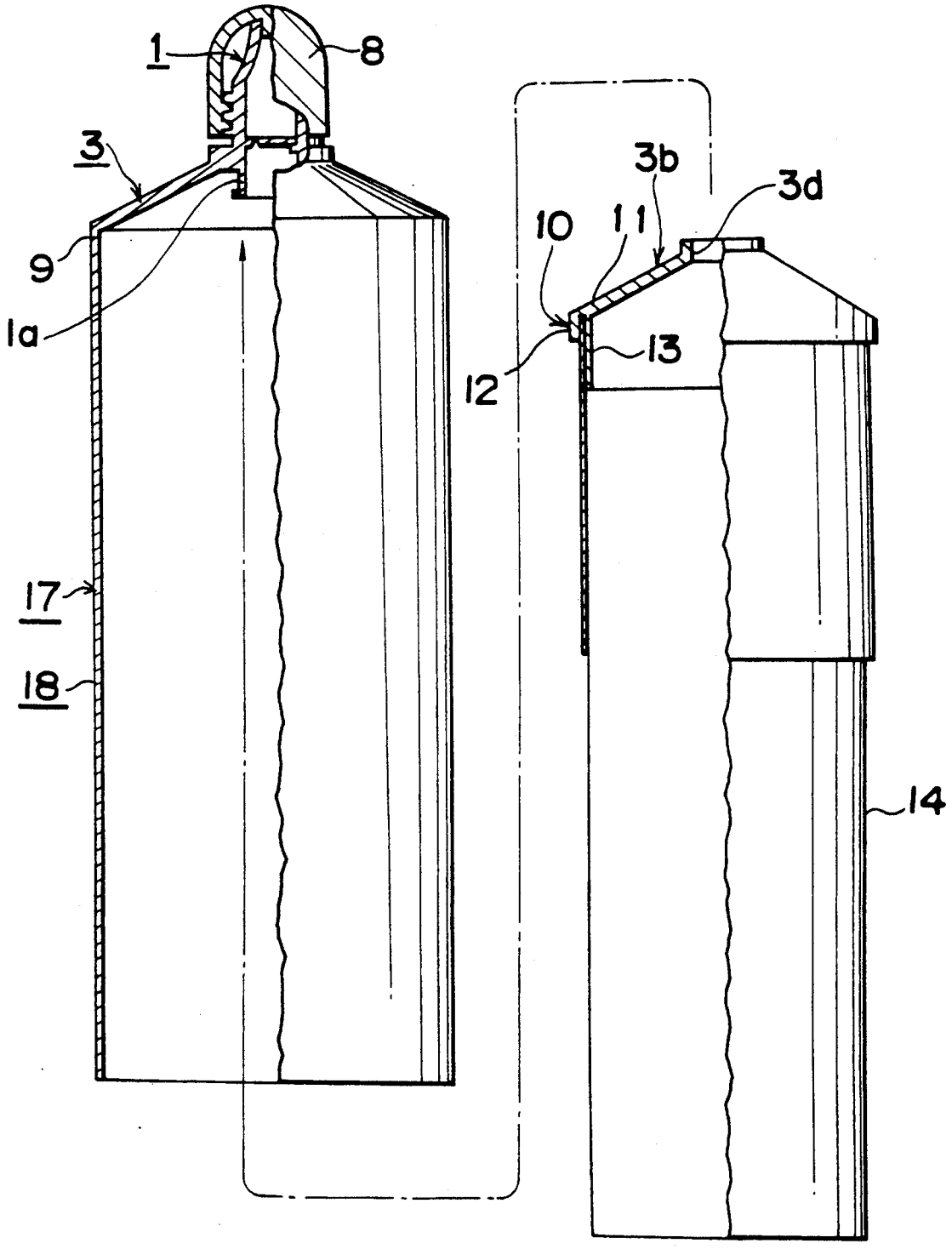
FIGS. 7 through 9 are explanatory views each showing a procedure in assembling the viscous liquid-dispensing container according to the second embodiment of the present invention.
Figure 8:
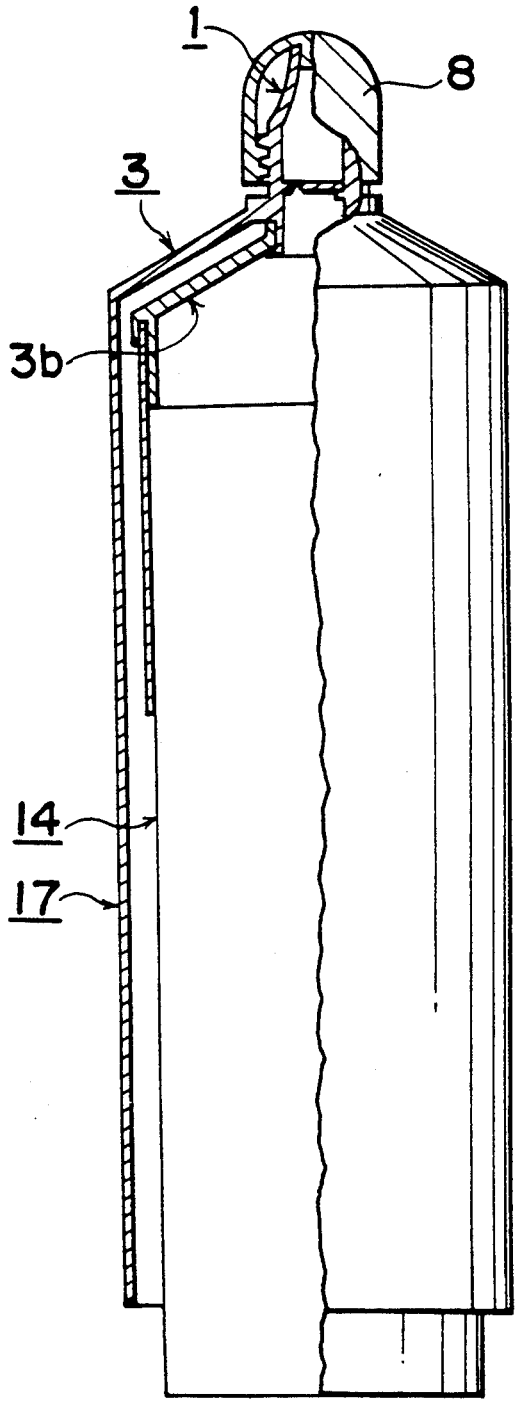
Figure 9:
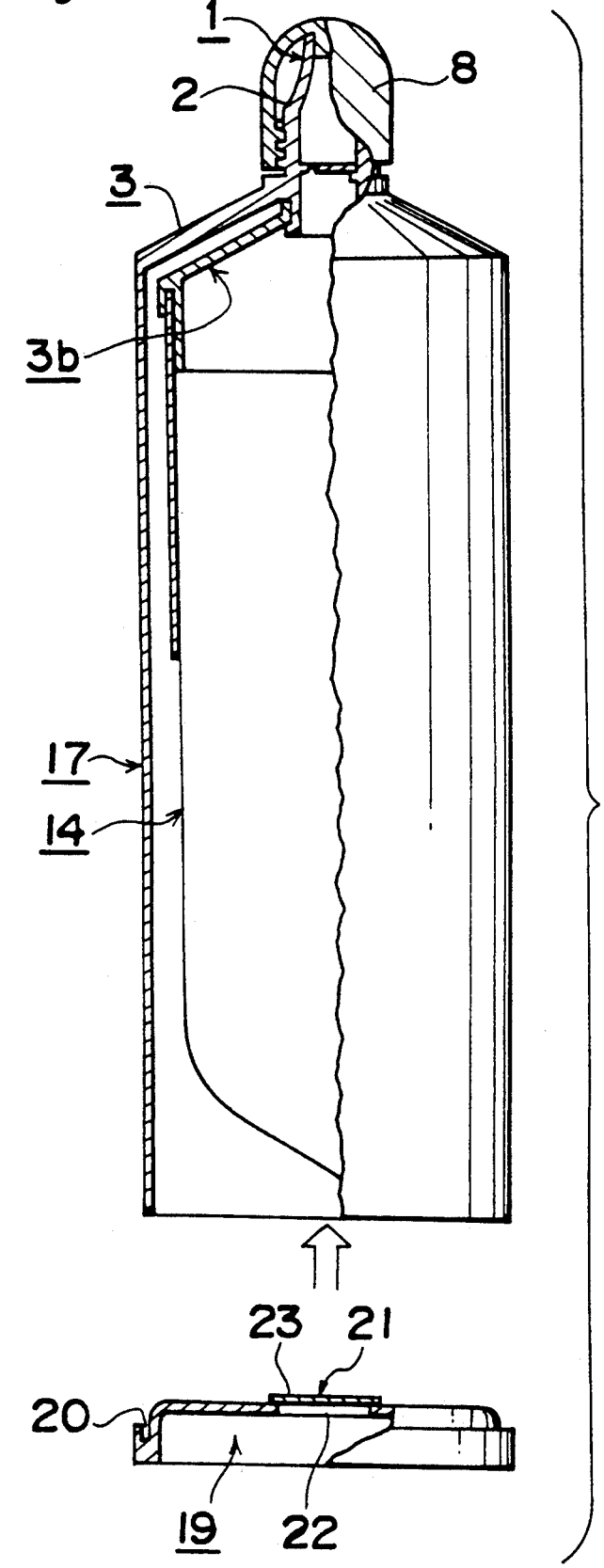

The procedure in assembling the viscous liquid-dispensing container in this embodiment is shown in FIGS. 7 through 9. That is, the assembled inner container 14 is installed inside the outer container 17 with the lower end of the lower tube 15 open as shown in FIGS. 7 and 8. The lower end **1*a* of the liquid-dispensing section 1 is fixedly fitted in an center opening 3*d* of the disc 3*b* of the shoulder member 3*b*. Subsequently, viscous liquid is charged into the inner container 14, and thereafter the open lower end of the inner container 14 is thermally sealed as shown in FIG. 9. Finally, the bottom lid member 19 is thermally welded to the lower end of the inner container 14**. In this manner, the viscous liquid-dispensing container is assembled.

In each of the embodiments shown in FIGS. 1–5 and 6–9, the viscous liquid-dispensing section 1, the inner container 14, and the outer container 17 are formed separately or partially integral with each other. It is also possible to form the outer container 17 by integrating the cylindrical portion 18 and the bottom lid member 19 with each other.

The operation of the liquid-dispensing container having above construction is as follows.

Upon compression of the outer sleeve 18 of the outer container 17, air between the inner container 14 and the outer container 17 is pressurized toward the inside of the inner container 14, namely, in the direction in which the inner container 14 is squeezed. As a result, a certain amount of the viscous liquid accommodated in the inner container 14 is extracted from the extracting opening 4 of the viscous liquid-dispensing section 1.

Upon stop of the operation for compressing the outer container 17, the outer container 17 is returned to the original configuration. As a result, air in a space 24 between the inner container 14 and the outer container 17 is decompressed depending on the amount of the viscous liquid extracted from the inner container 14. When the viscous liquid is extracted in a certain amount from the inner container 14 to the outside, normally, external air will flow from the extracting opening 4 of the head 2 at a high speed into the inner container 14. However, the first check valve 7 disposed in the extracting path 6 only allows the liquid to flow from the inside to the outside through the opening 4, but prevents the external air from flowing into the inner container 14. At this time, the second check valve 21 formed on the bottom lid member 19 allows the external air to be introduced into the space 24 disposed between the inner container 14 and the outer container 17. In this manner, the pressure in the space 24 becomes equal to that of the external pressure.

When the viscous liquid in the inner container 14 is extracted to a level in the vicinity of the lower end of the upper tube 16 as a result of repeated compressing operation, the flexible lower tube 15 is inverted and invades into the upper tube 16 due to the negative pressure generated in the inner container 14 as shown by a chair line in FIG. 6. As a result, most of the content of the inner container 14 can be extracted from the viscous liquid-dispensing section 1 to the outside by compressing the outer container 17.

What is claimed is:

1. A viscous liquid-dispensing container comprising:

a viscous liquid-dispensing section having an upstanding head and a mounting shoulder means radially extending from the lower end of the head, the head including an extracting opening at the upper end thereof, an introducing opening at the lower end thereof, means defining an extracting path for the viscous liquid between said openings, and a first check valve disposed in the extracting path to allow only extraction of the viscous liquid, the mounting shoulder means comprising a peripheral outer mounting portion and a depending annular inner mounting portion spaced radially inwardly from the outer mounting portion;

a tube-shaped inner container, for accommodating viscous liquid, comprising a lower bag made of a flexible thin film and an upper sleeve substantially uniformly harder than the lower bag and connected thereto, the upper end of the upper sleeve being connected with the depending annular inner mounting portion of the mounting shoulder means; and an elastic outer container surrounding the inner container, the upper end thereof being connected with the peripheral outer mounting portion of the mounting shoulder means, the outer container having a second check valve capable of introducing external air to the inside of the viscous liquid-dispensing container;

wherein the mounting shoulder means comprises a first shoulder having the peripheral outer mounting portion and further comprises a second shoulder having the depending annular inner mounting portion, the second shoulder extending radially from the lower end of the head and being axially spaced downwardly from the first shoulder and being connected with the lower end of the head such that the extracting path of the head communicates with the inside of the inner container.

2. A viscous liquid-dispensing container as claimed in claim 1, wherein the first shoulder and the outer sleeve of the outer container are formed integrally.

3. A viscous liquid-dispensing container comprising:

a viscous liquid-dispensing section having an upstanding head and a mounting shoulder means radially extending from the lower end of the head, the head including an extracting opening at the upper end thereof, an introducing opening at the lower end thereof, means defining an extracting path for the viscous liquid between said openings, and a first check valve disposed in the extracting path to allow only extraction of the viscous liquid, the mounting shoulder means comprising a peripheral outer mounting portion and a depending annular inner mounting portion spaced radially inwardly from the outer mounting portion;

a tube-shaped inner container, or accommodating viscous liquid, comprising a lower bag made of a flexible thin film and an upper sleeve substantially uniformly harder than the lower bag and connected thereto, the upper end of the upper sleeve being connected with the depending annular inner mounting portion of the mounting shoulder means; and an elastic outer container surrounding the inner container, the upper end thereof being connected with the peripheral outer mounting portion of the mounting shoulder means, the outer container having a second check valve capable of introducing external air to the inside of the viscous liquid-dispensing container;

wherein the peripheral outer mounting portion depends from the mounting shoulder means, and the depending peripheral outer mounting portion and the depending annular inner mounting portion each comprises a mounting sleeve having a downwardly opening annular groove at the lower end portion thereof for receiving the upper end of the elastic outer container and the upper end of the tube-shaped inner container, respectively.

* * * * *